United States Patent [19]

Omachi et al.

[11] Patent Number: 4,633,383

[45] Date of Patent: Dec. 30, 1986

[54] METHOD OF SUPERVISING OPERATING STATES OF DIGGING MACHINES

[75] Inventors: Yoshio Omachi; Eisaku Yamada, both of Hiratsuka, Japan

[73] Assignee: Kabushiki Kaisha Komatsu Seisakusho, Tokyo, Japan

[21] Appl. No.: 603,210

[22] Filed: Apr. 23, 1984

[30] Foreign Application Priority Data

Apr. 21, 1983 [JP] Japan ..... 58-70214

[51] Int. Cl.[4] ..... H02M 5/22; B65F 9/00; G05B 19/18

[52] U.S. Cl. ..... 364/167; 37/DIG. 19; 37/DIG. 1; 414/394

[58] Field of Search ..... 364/167, 168, 171, 174, 364/175, 188, 400, 505, 513, 424; 172/1, 2, 4, 126; 37/DIG. 1, DIG. 19, 195; 73/178 R; 901/47; 414/385, 399, 394, 728, 730

[56] References Cited

U.S. PATENT DOCUMENTS

| | | | |
|---|---|---|---|
| 4,129,224 | 12/1978 | Teach | 37/DIG. 1 |
| 4,149,251 | 4/1979 | Noordermeer et al. | 37/DIG. 1 |
| 4,231,700 | 11/1980 | Studebaker | 37/DIG. 1 |
| 4,288,196 | 9/1981 | Sutton, II | 172/4.5 |
| 4,332,517 | 6/1982 | Igarashi et al. | 37/DIG. 1 |
| 4,343,367 | 8/1982 | Mashimo | 364/167 |
| 4,393,600 | 7/1983 | Warnecke | 37/DIG. 19 |
| 4,482,960 | 11/1984 | Pryor | 37/DIG. 1 |
| 4,491,927 | 1/1985 | Bachmann et al. | 37/DIG. 1 |
| 4,504,918 | 3/1985 | Axmann | 364/478 |
| 4,519,026 | 5/1985 | Nozawa et al. | 364/171 X |

FOREIGN PATENT DOCUMENTS

| | | | |
|---|---|---|---|
| 3414771 | 10/1984 | Fed. Rep. of Germany | 37/DIG. 19 |
| 1464063 | 11/1965 | France | 37/DIG. 19 |
| 119042 | 9/1981 | Japan | 37/DIG. 19 |
| 106634 | 6/1984 | Japan | 37/DIG. 1 |
| 85/03096 | 7/1985 | PCT Int'l Appl. | 37/DIG. 19 |

*Primary Examiner*—Jerry Smith
*Assistant Examiner*—Jon D. Grossman
*Attorney, Agent, or Firm*—Spensley Horn Jubas & Lubitz

[57] ABSTRACT

Indices in the form of colored poles are installed on a ground surface to be digged, and the indices are picked up by a television camera set on one side of a digging machine so as to set a target digging line on rectangular coordinates. Marks are applied to suitable points of the machine and are also picked up by the television camera so as to detect the positions of the marks on the rectangular coordinates. The position of the cutting edge of the machine is calculated by taking the positions of the marks as references. The result of the calculation is stored in a memory device and its content is used to display the locus of the movement of the cutting edge on the screen of a monitor television installed in the cabin of the digging machine while at the same time the target digging line is also displayed on the screen.

10 Claims, 10 Drawing Figures

METHOD OF SUPERVISING OPERATING STATES OF DIGGING MACHINES

BACKGROUND OF THE INVENTION

Field of Invention

This invention relates to a method of supervising the operating state of a digging machine by using a television camera.

In a digging machine, for example a power shovel or the like, it is difficult to accurately know the operating state of the machine when it forms a slope or digs a ditch or the like.

For instance, at the time of digging an inclined surface a shown in FIG. 1 it is usual to stretch a reference wire b along the inclined surface a and to manipulate the digging machine c such that its front end is moved in parallel with the reference wire b. When digging a ditch or groove for installing telephone cables or aquaducts a workman enters into the ditch d as shown in FIG. 2 to teach to the operator of the digging machine the depth of the ditch and the attitude of the front end of the machine c.

With the method shown in FIG. 1, as the operation cycle time is long the operating efficiency decreases. Furthermore, the method shown in FIG. 2 requires an assistant workman the cost of operation increases.

SUMMARY OF THE INVENTION

Accordingly, it is an object of this invention to provide a novel method of supervising the operating state of a digging machine enabling the operator to supervise the operating state in the operating cabin of the machine.

To accomplish this object, according to this invention, there is provided a method of supervising the operating state of a digging machine, characterized by comprising the steps of providing indices representing ground surface to be digged; picking up the indices by a television camera located on one side of the digging machine so as to set a target digging line on rectangular coordinater based on the picked up indices; picking up with the television camera marks applied to predetermined portions of the digging machine so as to detect the positions of the marks on the rectangular coordinates; calculating the position of the cutting edge of the digging machine on the rectangular coordinates taking the positions of the marks as references; storing the result of calculation in a picture image memory device; displaying the target digging line on a monitor television screen disposed in the digging machine; and displaying a locus of movement of the cutting edge on the monitor television screen by using the contents of the picture image memory device.

Thus, according to the method of this invention, the locus of the movement of the cutting edge of the bucket of the digging machine and the target digging line are displayed on the screen of a monitor television installed in the cabin of the digging machine. Accordingly, the operator can perform the digging operation while viewing the displayed images so as to accurately dig slopes or ditches for burrying cables or ducts. Moreover, since the state of digging can be accurately monitored, the digging efficiency can be greatly improved.

DESCRIPTION OF THE PREFERRED EMBODIMENTS

Figure 1:
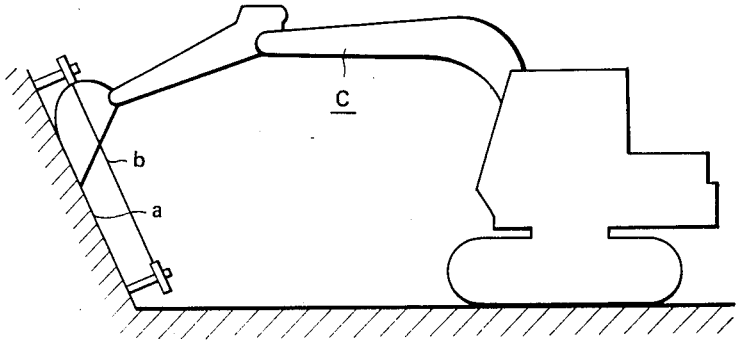
FIG.1 (PRIOR ART)
FIGS. 1 and 2 are diagrammatic representations of prior art methods, of digging ditches.
Figure 2:
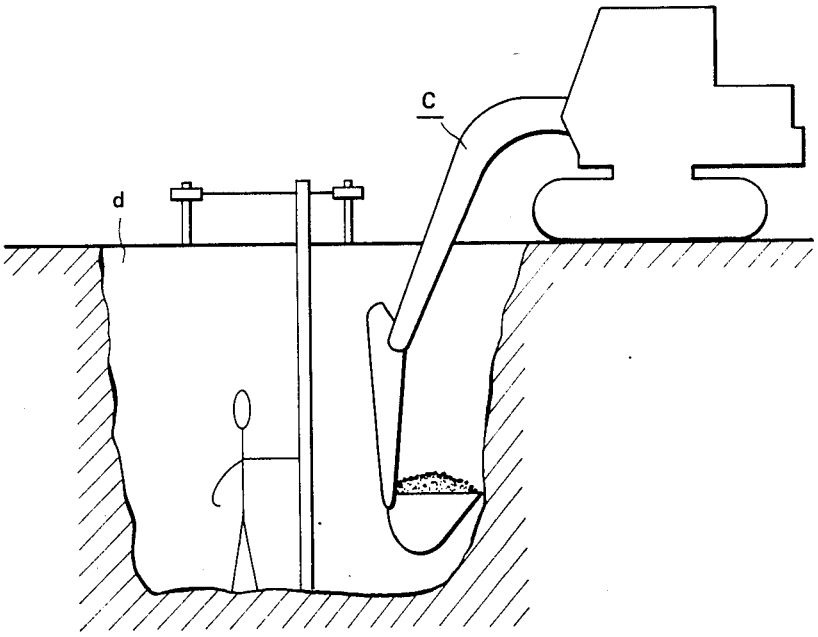
FIG.2 (PRIOR ART)
Figure 3:
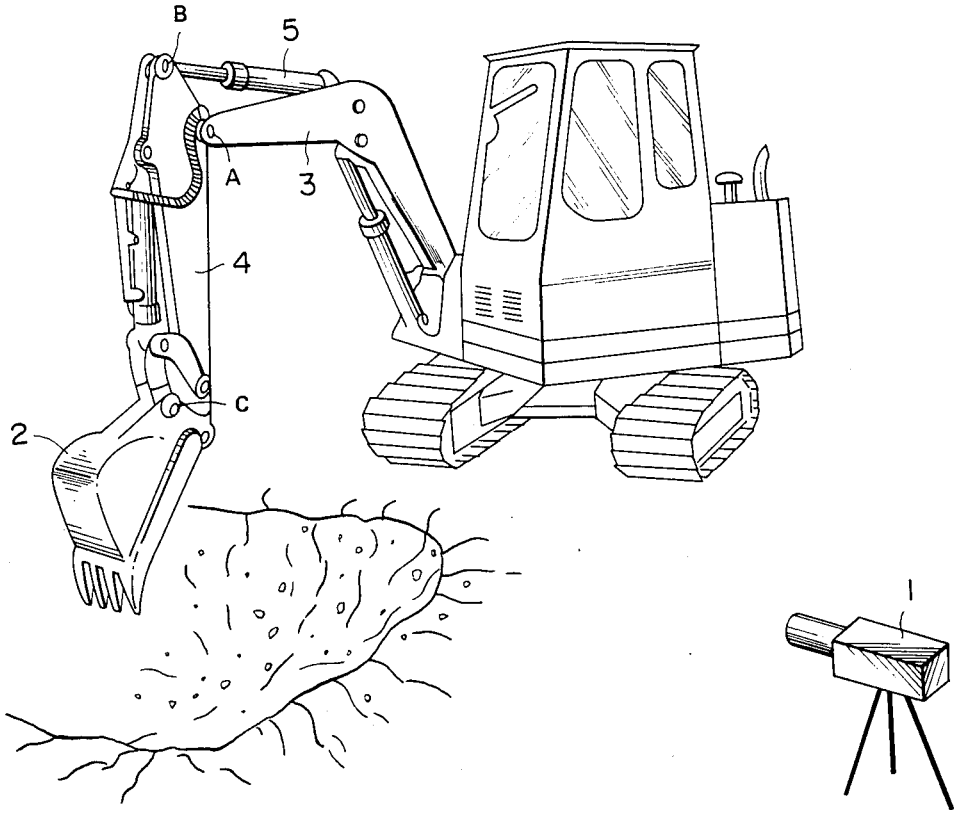
FIG. 3 is a perspective view showing a digging operation of a power shovel and the arrangement of a television camera.

According to the method of this invention, a television camera 1 is installed on one side of a digging machine, a power shovel in this example, as shown in FIG. 3 so as to calculate the locus of the position of the cutting edge of a bucket 2 by utilizing the picture image of the television camera 1.

As shown in FIG. 3, let us now designate the pivot point between the front end of the boom 3 and the arm 4 of the power shovel by A, and the pivot point between the piston rod of arm driving cylinder 5 and the base of the arm 4 by B, and the pivot point between the front end of the arm 4 and the bucket 2 by C. According to one design, the length of segment $\overline{AB}$ and the angle $\phi$ between segments $\overline{AB}$ and $\overline{BC}$ are always constant.

Figure 4:
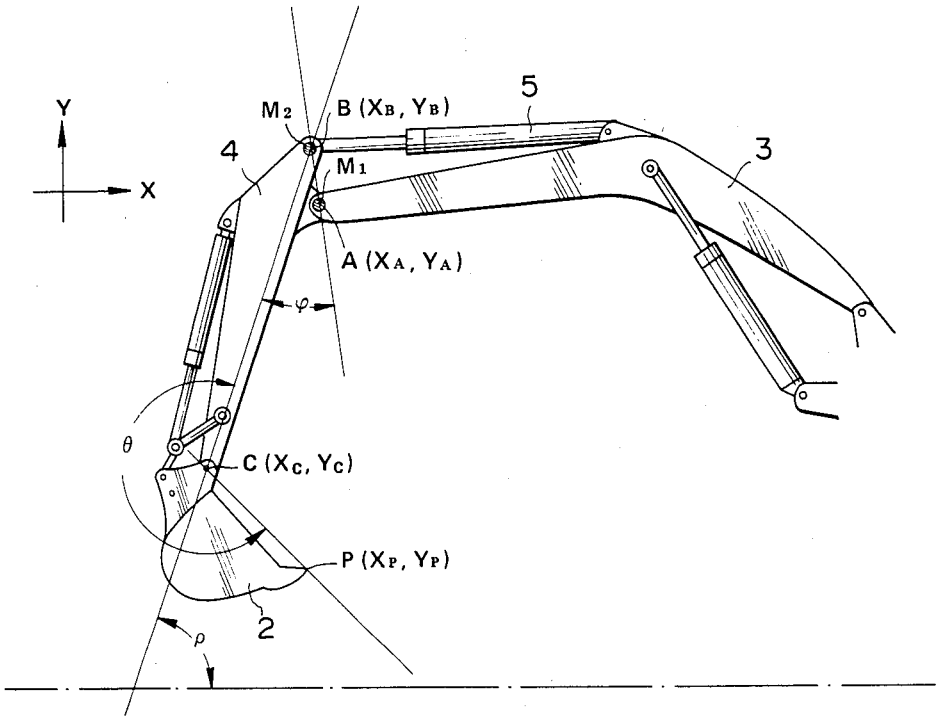
FIG. 4 shows a side view of a power shovel for geometrically determining the locus of the front end of a bucket.

Referring to FIG. 4, coordinates, $(X_A, Y_A)$, $(X_B, Y_B)$ and $(X_C, Y_C)$ represent the positions of the points A, B, and C in the fixed coordinate system established on the screen of the TV camera.

Assuming now that the coordinates of the points A and C are $(X'_A, Y'_A)$ and $(X'_C, Y'_C)$ in an X-Y coordinate system with the point B as its origin. Then, the coordinates $(X'_C, Y'_C)$ can be obtained by rotating the point A by the angles $-\phi$ (negative means clockwise direction) with respect to the point B and then multiplying the rotated point A by $K=\overline{BC}/\overline{AB}$.

This can be expressed as the following matrix equation:

$$\begin{bmatrix} X'_C \\ Y'_C \end{bmatrix} = k \begin{bmatrix} \cos(-\phi) & \sin(-\phi) \\ -\sin(-\phi) & \cos(-\phi) \end{bmatrix} \begin{bmatrix} X'_A \\ Y'_A \end{bmatrix} \quad (1)$$

Further, assuming that the coordinates of the points B and P are $(X''_B, Y''_B)$ and $(X''_P, Y''_P)$ in an X-Y coordinate system with the point C as its origin. Then, the coordinates $(X''_P, Y''_P)$ can be obtained by rotating the point B by the angled $\theta$ with respect to the point C and then by multiplying the rotated point B by $r=\overline{CP}/\overline{BC}$.

This operation can be expressed by the following matrix equation.

$$\begin{bmatrix} X''_P \\ Y''_P \end{bmatrix} = r \begin{bmatrix} \cos\theta & \sin\theta \\ -\sin\theta & \cos\theta \end{bmatrix} \begin{bmatrix} X''_B \\ Y''_B \end{bmatrix} \quad (2)$$

The coordinates of the point P ($X_p$, $Y_p$) in the X-Y coordinate system fixed on the TV screen is obtained by adding the coordinates ($X_B$, $Y_B$), ($X'_C$, $Y'_C$) and ($X''_p$, $Y''_p$). Consequently, the positions A and B on the rectangular coordinates are given by the television camera shown in FIG. 3 and when the bucket angle $\theta$ is given, the position of the front edge P of the bucket can be calculated.

According to this method, circular marks $M_1$ and $M_2$ or different colors, for example red and green, are applied to points A and B and these marks are photographed by the television camera.

Figure 6:
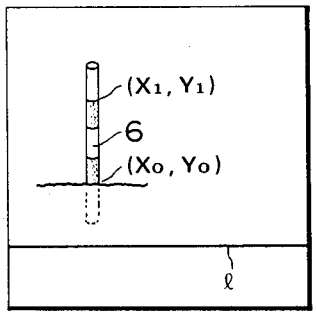
FIG. 6 is a diagrammatic representation of a method for depicting a digging target line displayed on the screen of a cathode ray tube.

One embodiment of the method of this invention will now be described with reference to FIGS. 5, 6, 7.

A method of displaying a target digging line shown in FIG. 6 on the screen of a monitor television 13 will first be described. In this embodiment, a pole 6 is placed on the ground and the position (level) of the target digging line is determined based on the image of the pole 6 on the screen.

Figure 5:
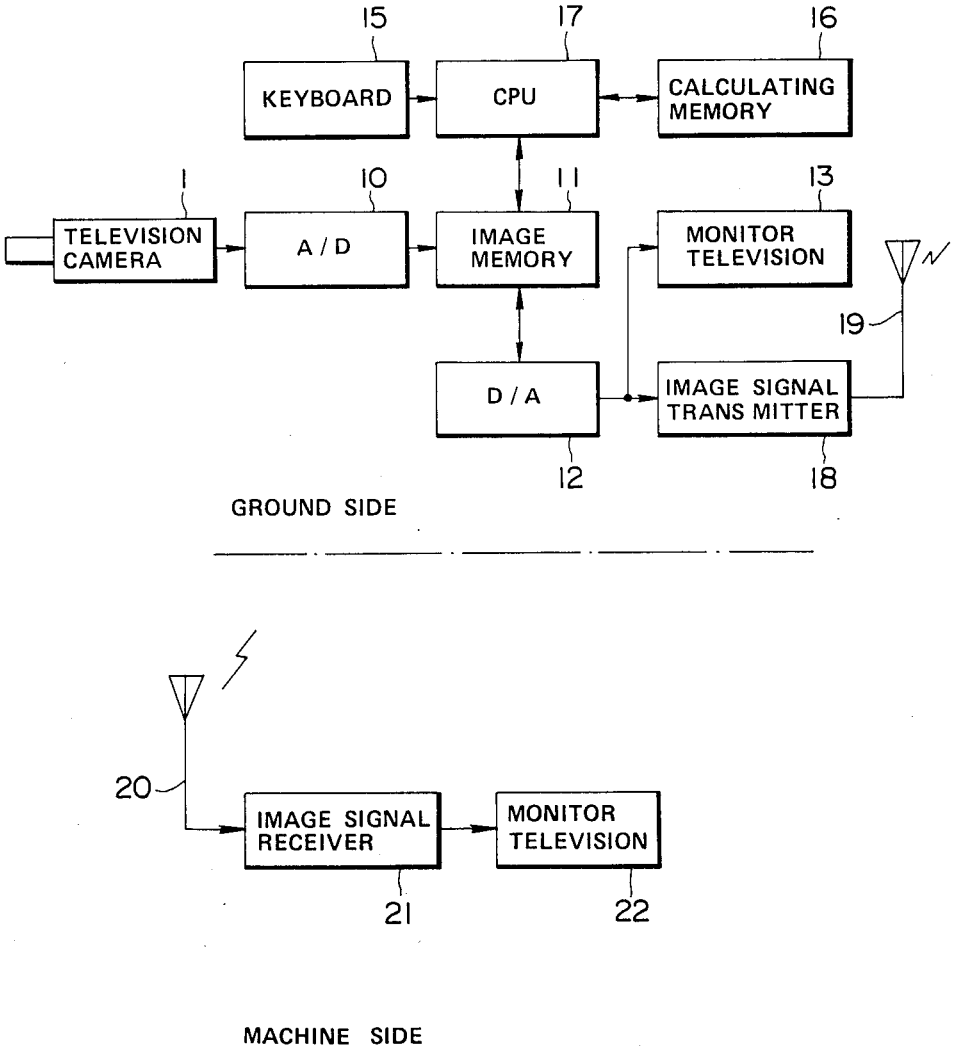
FIG. 5 is a block diagram showing the electric connection of an apparatus for carrying out the method of this invention.

More particularly, the output of the television camera 1 is fed to the monitor television 13 via an A/D converter 10, an image memory device 11 and a D/A converter 12, as shown in FIG. 5. On the screen of the monitor television, the pole 6 is displayed as shown in FIG. 6.

The pole 6 is coated with white and black colors alternately. The lower end of the pole 6 on the screen shows the surface of the ground to be dug. The distance between the point ($X_o$, $Y_o$) and the point ($X_1$, $Y_1$) corresponds to 30 cm at the digging place. Then, a cursor not shown is successively placed at the point ($X_o$, $Y_o$) and ($X_1$,$Y_1$) these points in the memory device 16.

In a central processing unit (CPU) 17, the distance between the points ($X_o$, $Y_o$) and ($X_1$, $Y_1$)

$$\sqrt{(X_1 - X_o)^2 + (Y_1 - Y_o)^2}$$

is calculated. In the case, where the pole 6 stands vertically, the coordinate $X_1$ is equal to the coordinate $X_o$ and therefore the above distance is equal to $Y_1 - Y_o$.

Thus, the length on the screen corresponding to 30 cm at the digging place is obtained. When, for example, up to 30 cm below the ground surface is to be dug, the target digging line will be displayed on the screen at a place the length corresponding to 30 cm below the lower end of the pole.

The image memory device 11 stores data representing the position to be displayed on the screen, which data is transmitted to the digging machine together with data representing the position ($X_p$, $Y_p$) of the cutting edge of the bracket 2.

Then the poles are removed, and the photographing of the actual digging state is commenced. The camera 1 is a color television camera so that when the red mark $M_1$ and green mark $M_2$ are picked up, an electronic circuit contained in the camera extracts only the colors of these marks. The camera 1 picks up the marks $M_1$ and $M_2$ as spots. As a consequence, the picture images of these marks $M_1$ and $M_2$ are stored in the image memory device 11 as rectangular coordinate positions ($X_A$, $Y_A$) and ($X_B$, $Y_B$).

In accordance with the positions ($X_A$, $Y_A$) and ($X_B$, $Y_B$) stored in the image memory device 11, the CPU 17 calculates the angle between the segment $\overline{AB}$ shown in FIG. 3 and the target digging line l. The CPU further calculates the angle $\rho$ shown in FIG. 4 based on the angle thus obtained and the constant angle $\phi$. The calculating memory device is prestored with an optimum bucket angle $\theta$ regarding the value of the angle $\rho$ so that the CPU reads out from the memory device 16 an optimum bucket angle $\theta$ corresponding to the calculated angle $\rho$.

Then the CPU 17 executes the operations of equations (1) and (2) based on the contents ($X_A$, $Y_A$) and ($X_B$, $Y_B$), the lengths of sections $\overline{AB}$, $\overline{BC}$ and $\overline{CP}$ shown in FIG. 4 picked up by the television camera, the angle $\phi$ and the bucket angle $\theta$ to calculate the position ($X_P$, $Y_P$) of the cutting edge P of the bucket 2, which is displayed on the screen of the television. In accordance with the changes of the positions ($X_A$, $Y_A$) and ($X_B$, $Y_B$), the position ($X_P$, $Y_P$) of each picture is stored in the image memory device 11.

A picture image corresponding to the position ($X_P$, $Y_P$) of each picture stored in the image memory device 11 and a picture image representing the target digging line l are transmitted by an antenna 19 through a D/A converter 12 and an image signal transmitter 18. The transmitted picture images are received by an image signal receiver 21 via a receiving antenna 20 provided for the power shovel. Then, as shown in FIG. 7, the locus of the movement of the cutting edge P of the bucket 2 and the target digging line l are displayed on the screen of a monitor television 22 installed in the operator room or cabin of the power shovel. Accordingly, the operator can recognize the relation between the digged depth and the target line l when he sees the screen of the monitor television. It should be understood that the target digging line l may be inclined or curved. When the digging is made such that the point P shown in FIG. 4 can be caught by the television camera 1, by detecting the position of point P, the locus of movement of the cutting edge of the bucket can be determined more accurately.

A modified embodiment of this invention will now be described. Although in the foregoing embodiment, the cutting edge P of the bucket 2 was detected by picking up the positions ($X_A$, $Y_A$) and ($X_B$, $Y_B$) of the marks $M_1$ and $M_2$ with the television camera, the cutting edge P can also be detected by the following method.

Figure 8:
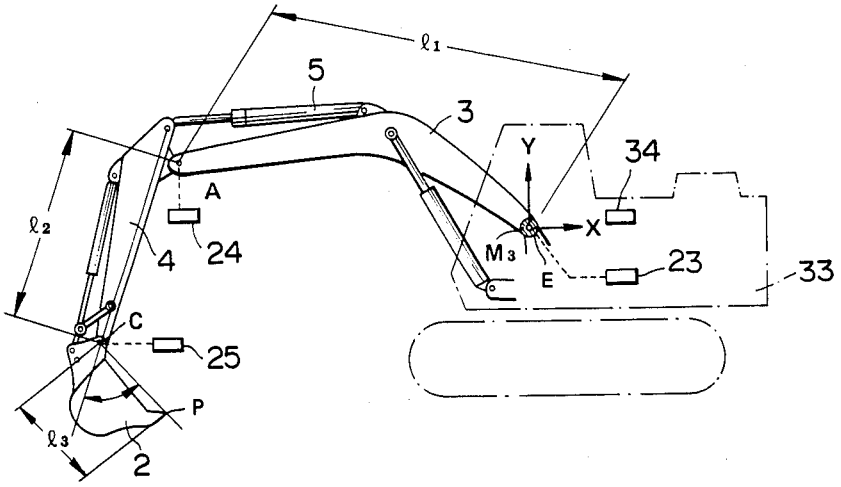
FIG. 8 is a side view showing the arrangement of angle detectors.
Figure 9:
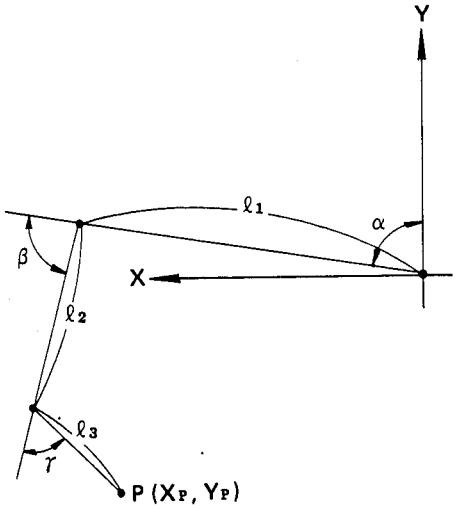
FIG. 9 shows the relative position of the boom, arm and bucket on a X-Y plane of rectangular coordinates.
Figure 10:
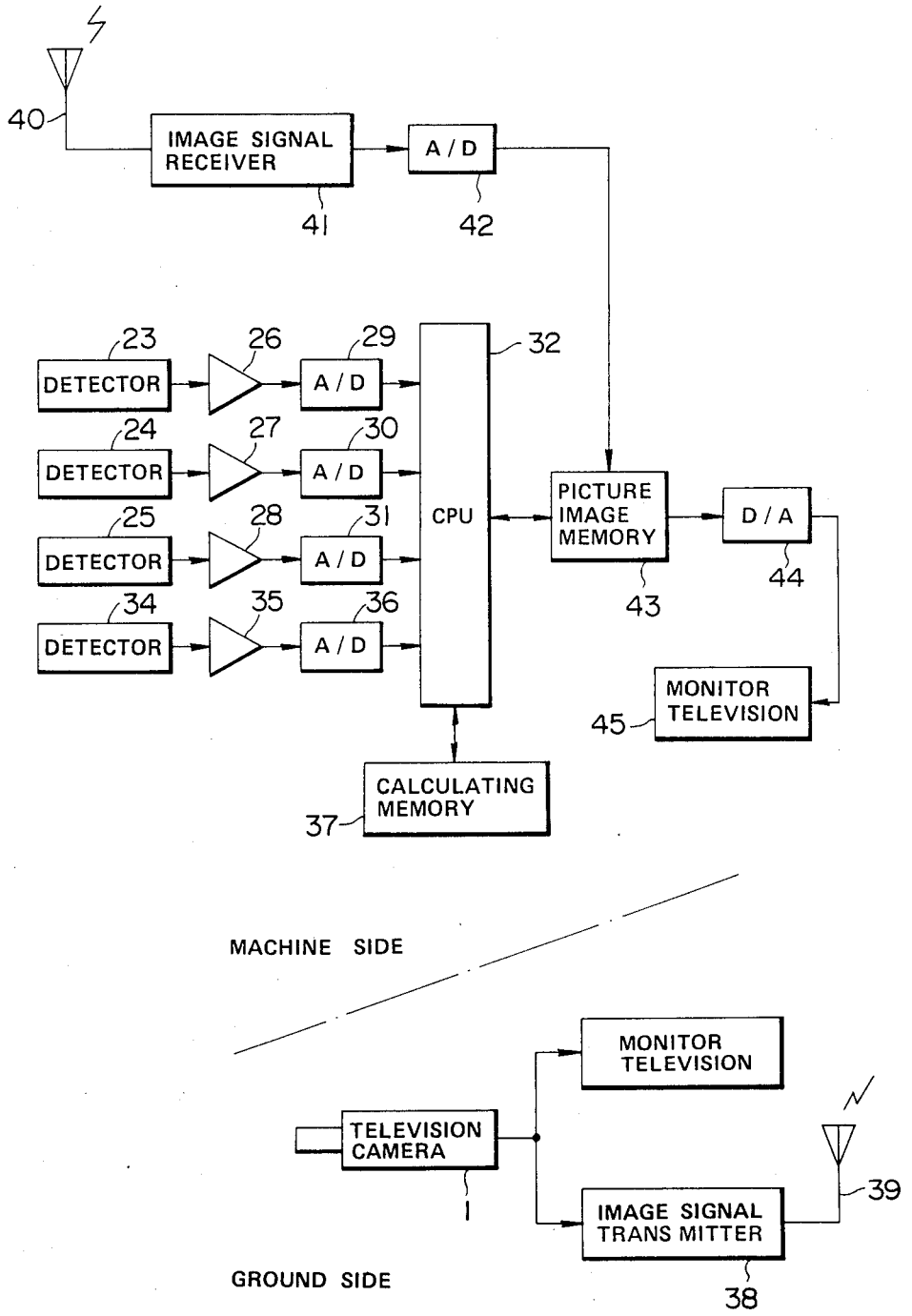
FIG. 10 is a block diagram showing a modified electric circuit utilized for carrying out the method of this invention.

More particularly, let us represent the length of boom 3, arm 4 and bucket 2 by $l_1$, $l_2$ and $l_3$ respectively as shown in FIG. 8, and let us denote the angle of rotations of these members by $\alpha$, $\beta$ and $\gamma$ respectively as shown in FIG. 9. Then, the position ($X_P$, $Y_P$) of the cutting edge of the bucket with reference to the pivot point of the boom 3 is given by the following equations:

$$X_P = l_1 \cdot \sin\alpha + l_2 \cdot \sin(\alpha+\beta) + l_3 \cdot \sin(\alpha+\beta+\gamma) \quad (3)$$

$$Y_P = l_1 \cdot \cos\alpha + l_2 \cdot \cos(\alpha+\beta) + l_3 \cdot \cos(\alpha+\beta+\gamma) \quad (4)$$

In this modification, angle detectors in the form of potentiometers, for example, 23, 24 and 25 for detecting the angle of rotations $\alpha$, $\beta$ and $\gamma$ are provided at respective pivot points E, A and C of the boom 3, arm 4 and bucket 2, and the outputs of these angle detectors are applied to a CPU 32 respectively through amplifiers 26, 27 and 28 and A/D converters 29, 30 and 31. For the purpose of compensating for the displacement of the cutting edge P of the bucket when the digging machine inclines in the vertical direction, an inclination angle detector 34 is mounted on the digging machine and the output of this detector 34 is applied to the CPU via an amplifier 35 and an A/D converter 36.

According to this modification, a mark $M_3$ of a specific color is applied to the pivot point E of the boom 3 and this mark $M_3$ is picked up by the television camera 1. The picked up image is sent by a transmitting antenna 39 via an image signal transmitter 38.

The CPU 32 executes the operations of equations (3) and (4) based on the outputs of the A/D converters 29-31 and 36, data representing the lengths $l_1$, $l_2$ and $l_3$ prestored in the calculating memory device 37, and the mark $M_3$ stored in a picture image memory device 37 through a receiving antenna 40, an image signal receiver 41 and an A/D converter 42, whereby the cutting edge position P of the bucket added with the inclination angle of the digging machine and displayed on the screen is calculated by taking the position of the mark $M_3$ on the screen as a reference, and the result of this calculation is stored in the picture image memory device 43.

In this manner, the variation of the position of the cutting edge of the bucket caused by the variation in the angles $\alpha$, $\beta$ and $\gamma$ are stored in the picture image memory device 43 from time to time and the content thereof is supplied to a monitor television 45 installed in the cabin of the digging machine via a D/A converter 44. As a consequence, the monitor television displays the locus of the cutting edge position of the bucket as shown in FIG. 7. In other words, the target digging line l is set in the same manner as in the previous embodiment.

Although in the foregoing embodiments only the locus of the cutting edge position of the bucket was displayed on the monitor television, it is possible to display the locus superposed on all picture images picked up by the television camera.

Furthermore, in the embodiment shown in FIG. 8 and 9, it is possible to calculate the positions E, A and C of the boom 2, the arm 4 and the bucket 2 and the cutting edge position P of the bucket so that it is possible to depict patterns showing the boom 3, arm 4 and bucket 2 on the monitor television 45 by using computer graphic technique. Thus, the operating stage of the digging can be monitored more precisely.

Figure 7:
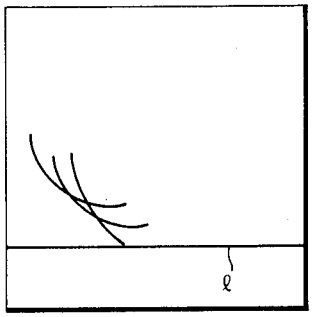
FIG. 7 is a graph showing a case wherein the locus of the front end of the bucket and the digging target line are displayed on the screen of a cathode ray tube.

According to this invention, since marks $M_1$, $M_2$ and $M_3$ are picked up by a television camera and the position of the cutting edge of the bucket is calculated by using the positions of these marks as references so that when the machine moves fore and aft, the pattern of the locus shown in FIG. 7 moves in the horizontal direction by a distance corresponding to the distance of movement of the machine.

What is claimed is:

1. A method of supervising operating states of a digging machine comprising the steps of:

providing indices representing the ground surface to be digged and an object of known length;

picking up said indices by a television camera located to one side of said digging machine so as to scale said television camera image to actual size and enable a target digging line to be set on rectangular coordinates based on the picked up indices;

picking up with said television camera at least one mark applied to a predetermined portion of said digging machine so as to detect the position of said mark on said rectangular coordinates;

calculating the position of an out of camera view cutting edge of said digging machine on said rectangular coordinates taking the position of said mark as reference;

storing the calculated position of said cutting edge in a picture image memory device;

graphically displaying said target digging line in a monitor television screen visible to the operator of said digging machine; and graphically displaying a locus of movement of said cutting edge on said monitor television screen by using the contents of said picture image memory device.

2. The method according to claim 1 wherein said marks applied to said digging machine have specific colors.

3. The method according to claim 1 wherein said digging machine comprises a power shovel.

4. The method according to claim 3 wherein said mark application step comprises employing a first mark applied to a pivot point of an arm of said power shovel, and a second mark applied to a pivot interconnecting said arm and an arm driving piston assembly.

5. The method according to claim 4 wherein said calculating step calculates the position of a bucket of said power shovel using the coordinate positions of said first and second marks as references.

6. The method according to claim 5 wherein said calcualting step comprises the steps of determining a position of the pivot point of said bucket based upon the positions of said first and second marks and a length between said first mark and the pivot point of said bucket, and determining a position of cutting edge of said bucket based on the position of said pivot point and a bucket angle.

7. The method according to claim 6 wherein said calculating step further comprises the steps of calculating and angle $\rho$ of said arm with respect to said digging line based on the position of said first and second marks, and reading out a bucket angle $\theta$ corresponding to said angle $\rho$ from memory means.

8. The method according to claim 3 wherein said mark is applied to a pivot point of a boom of the power shovel and a coordinate position of a cutting edge of said bucket is calculated based on the position of said mark on said rectangular coordinates.

9. The method according to claim 8 wherein the position of said cutting edge is calculated based on the position of said mark, lengths of the boom, arm and bucket of said power shovel and rotation angles of said boom, arm and bucket.

10. The method according to claim 9 wherein said rotation angles are measured by angle detecting means respectively provided for pivot points of said boom, arm and said bucket.

* * * * *